US005682933A

United States Patent [19]

Martel

[11] Patent Number: 5,682,933

[45] Date of Patent: Nov. 4, 1997

[54] WOOD TURNING TOOL

[76] Inventor: André Martel, 167, rang des Ecossais, St-Césaire, Québec, Canada, J0L 1T0

[21] Appl. No.: 630,749

[22] Filed: Apr. 10, 1996

[51] Int. Cl.[6] ..... B27C 7/00

[52] U.S. Cl. ..... 142/56

[58] Field of Search ..... 142/56

[56] References Cited

U.S. PATENT DOCUMENTS 1,003,584 9/1911 Calahan ..... 142/56

OTHER PUBLICATIONS

"Turning Tools That Cut", in Fine Woodworking on Faceplate Turning (Newtown, Ct.: The Taunton Press, 1987), pp. 32–34.

Craft Supplies USA Catalog, 1992–93, p. 18.

*Primary Examiner*—Steven C. Bishop

[57] ABSTRACT

A wood turning tool having first and second cutting edges and which is suitable for carving many different configurations of recesses from wood. The tool has a shank portion and a cutting head portion, the cutting head portion having first and second arcuate segments, the first and second arcuate segments generally lie in different planes, the cutting edges being located adjacent the point of merger of the first and second arcuate segments.

6 Claims, 5 Drawing Sheets

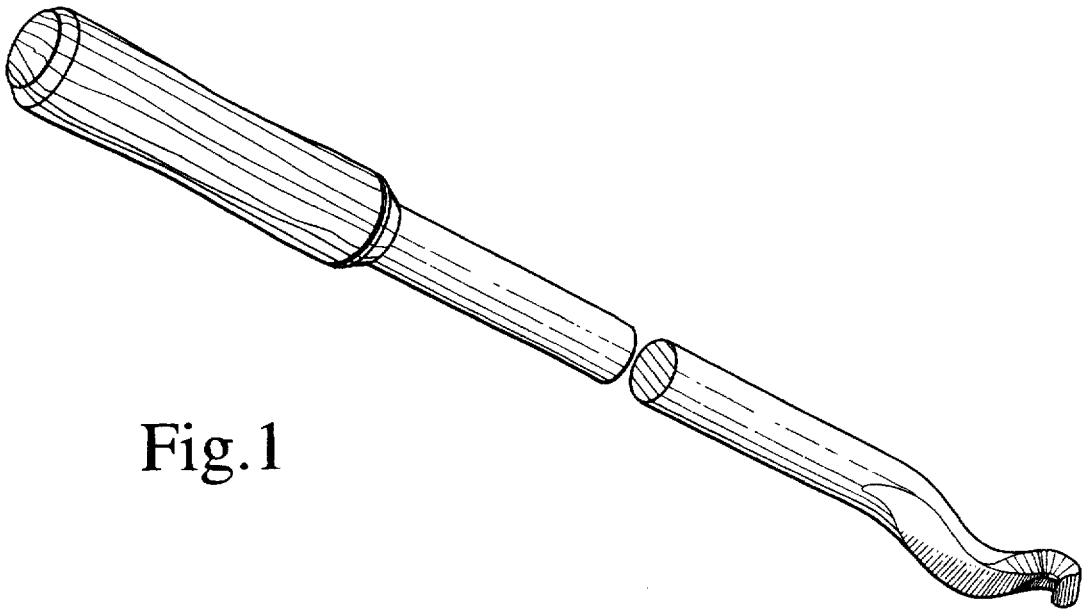
Fig.1
Fig.2
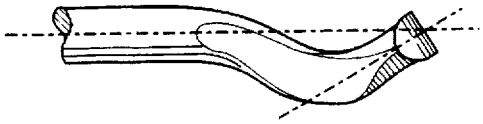
Fig.3
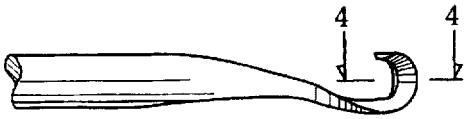
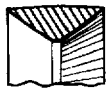
Fig.4
Fig.5
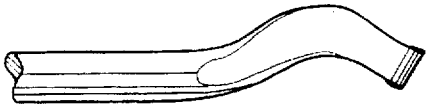
Fig.6
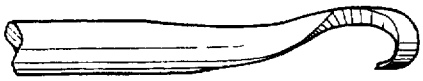

WOOD TURNING TOOL

BACKGROUND OF THE INVENTION

The present invention relates to the field of wood turning tools and more particularly, relates to a hand held wood turning tool for allowing an intended user to cut a turning workpiece in a variety of configurations.

BACKGROUND—PRIOR ART

The field of wood turning tools is replete with a variety of tools which can be used to shape wood workpieces.

Whenever a workpiece needs to have a recess formed therein, cutting tools such as chisels and gouges as well as scraping tools are used to permit rapid rough cutting and scraping followed by a more careful fine surface finishing of the wood surface in order to form an article having a recess therein.

In using these tools, a cutting edge is usually pushed into the wood fibers to force their severing and, particularly in the process of end-grain hollowing of wood pieces, that pushing occurs against or across the grain of the wood. The use of such a technique requires considerable expertise and concentration on the part of the tool-turner in order to minimize ragged tearing of the wood fibers or even more serious gouging of the wood.

In order to circumvent the above mentioned disadvantages, a wood turning tool has been proposed and is disclosed in U.S. Pat. No. 4,754,787. Although relatively efficient, the tool described in the above mentioned patent suffers from at least one drawback. While, this type of tool is particularly useful for forming hemispherical hollow shapes, it is not very well adapted to form oval or other shapes which are often desired.

Accordingly, it is an object of the present invention to provide a wood turning tool which is suited to form recesses in wood articles such as bowls, goblets, canisters and other containers.

It is another object of the present invention to provide a tool which optimizes the wood turning procedure.

It is a further object of the present invention to provide a wood turning tool in accordance with the previous objects which will conform to conventional forms of manufacturing, be of simple construction and easy to use, as well as to provide a wood turning tool which will be economically feasible, long lasting and relatively trouble-free in operation.

According to one aspect of the present invention, there is provided a wood turning tool comprising a shank portion and a cutting head, the cutting head having, a first arcuate portion and a second arcuate portion, the shank portion having a longitudinal axis, the first arcuate section having a longitudinal axis which is arcuate and lies in a first plane which is angled with respect to a plane along the longitudinal axis of the shank portion, a second arcuate section merging with the first arcuate section, the second arcuate section having a longitudinal axis which is arcuate and which axis lies in a second plane which is angled with respect to the shank longitudinal axis plane and the first plane, the first and second arcuate segment having first and second cutting edges, the first and second cutting edges being on substantially opposed sides of the cutting tool.

In a further aspect of the invention there is provided a wood turning tool comprising a longitudinally extending member having a shank section, a first arcuate section, and a second arcuate section, the shank portion having a longitudinal axis, the first arcuate section having a longitudinal axis which has a concave configuration, the second arcuate segment merging with the first arcuate segment, the second arcuate segment having a longitudinal axis of a generally U-shaped configuration, the longitudinal axis of the second arcuate section being angled with respect to the longitudinal axis of the first arcuate section, and first and second cutting edges located proximate a point where the first and second arcuate sections merge.

In greater detail, the wood turning tool has a shank portion with a cutting head at one end of the tool shank. As will be appreciated, many arrangements are possible including a relatively short shank portion connected to a handle or other suitable member. Normally, the shank will have a substantial length although this is not an essential part of the invention. A convenient arrangement would be one wherein the shank and cutting head are formed as a single unitary member.

The cutting head will provide for two different cutting edges, with the cutting edges being in a somewhat opposed relationship to each other as will be described in the preferred embodiments hereinbelow.

The tool may be formed of any suitable material which is adapted for the purpose. Traditionally, a suitable steel material such as a hardened tool steel which can be sharpened.

The cutting head tool of the present invention, as above described, includes a first arcuate section which has a somewhat U-shaped or concave configuration when seen from a side elevational view. It will be understood that although the shank and cutting head can have various cross sectional configurations, when reference is made to the longitudinal axis, it is employed in the general sense in that the shank and cutting head both have an axis extending in the longitudinal direction of the elongated tool.

The cutting head has a second arcuate section which is a continuation of the first arcuate section; the second arcuate section extends in a direction which is different from the first arcuate section. The second arcuate section may have a somewhat sharper cross sectional profile than the first arcuate section.

The angles of the arcuate sections can be changed so as to provide a desired effect. Thus, one could have a different angle such that the tool is specifically designed for forming a recess of different configurations as will be described hereinbelow.

BRIEF DESCRIPTION OF THE DRAWINGS

Having thus generally described the invention, reference will be made to the accompanying drawings illustrating an embodiment thereof, in which:

FIG. 1 is a partial perspective view illustrating a wood turning tool having a shank and cutting head in accordance with an embodiment of the present invention;

FIG. 2 is side elevational view of the cutting head of the tool of FIG. 1;

FIG. 3 is a bottom view, of FIG. 2;

FIG. 4 is a cross-sectional view taken along arrows 4—4 of FIG. 3;

FIG. 5 is a rear view of FIG. 2;

FIG. 6 is a top view of FIG. 2;

DETAILED DESCRIPTION OF THE INVENTION

Figure 7:
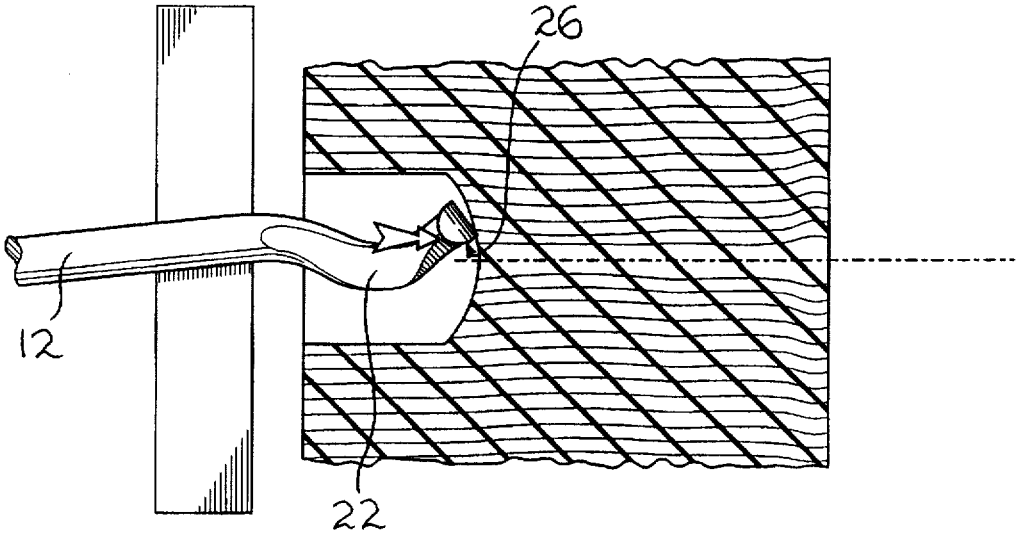
FIG. 7 is a partial cross-sectional view, illustrating a wood turning tool in accordance with the present invention being used to carve a recess in a wood article.

Referring to FIG. 1, there is shown a wood turning tool 10 in accordance with an embodiment of the present invention. The wood turning tool 10 has a substantially elongated shank 12 which has generally circular cross-sectional configuration. Tool shank 12 has a longitudinally extending shank longitudinal axis A. Tool shank 12 has a proximal end 14 and a distal end 16. Proximal end 14 may be conventionally attached to a conventional wood turning handle (not shown) which is gasped by the wood turning operator during use.

A cutting head section 18 is formed integrally with and merges with distal end 16 of shank 12. As seen in FIGS. 2, 3, 5 and 6 the cutting head has a first arcuate segment generally designated by reference numeral 22 and which has a generally concave configuration. Arcuate segment 22 in turn merges with a second arcuate segment 24 which has an overall U-shaped configuration.

When seen from the side, as illustrated in FIGS. 2 and 5, the cutting head section 18 has a substantially"V"-shaped configuration. The cutting head section 18 also has a distal end surface 20. The distal end surface 20 is angled relatively to the shank longitudinal axis A. The shank longitudinal axis A extends substantially centrally across the distal end surface 20.

When seen from the top and bottom, as illustrated respectively in FIGS. 6 and 3, the cutting head 18 has a substantially U-shaped configuration forming arcuate segment 24. The configuration of segment 24 influences the type of hollow shapes which can be formed into the wood being carved. For example, a generally U-shaped configuration such as the one illustrated in FIG. 3 of the segment 24 will allow for a substantially U-shaped wall to be formed in the hollowed article, whereas a substantially V-shaped segment would allow for a more obtuse angle of the hollowed-out portion.

As illustrated in FIGS. 2 and 5, the width T of the blade can influence the shape of the hollowed out segment in the wood. In this respect, the cutting head has a first sharpened edge 26 and a second sharpened edge 28 at the distal end of the bottom edge located proximate the point of merger of arcuate segments 24 and 22.

Figure 8:
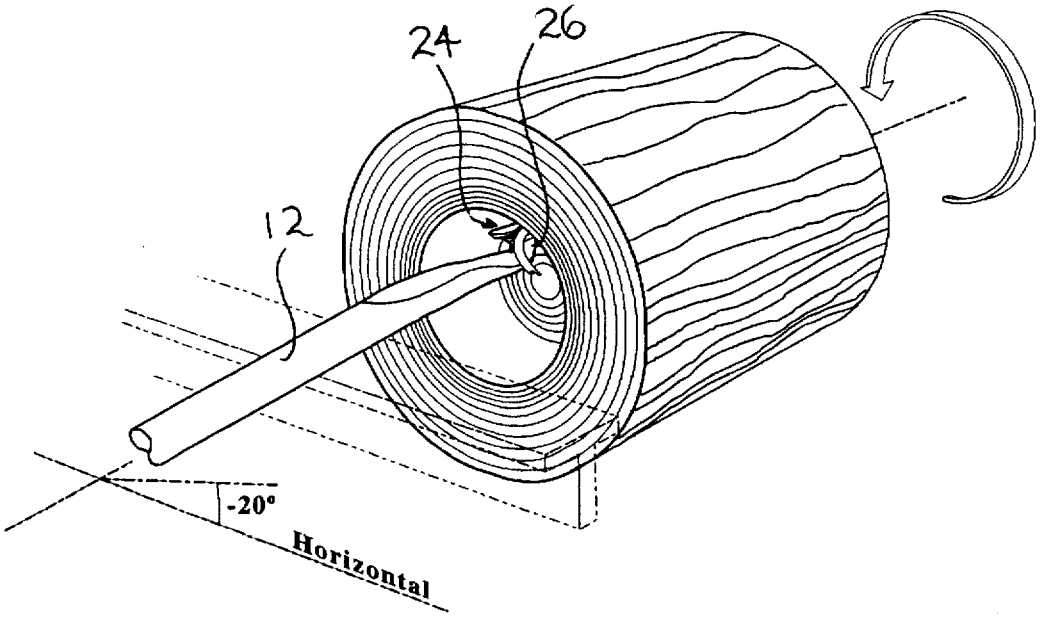
FIG. 8 is a perspective view illustrating use of a wood turning tool as shown in FIG. 7.
Figure 9:
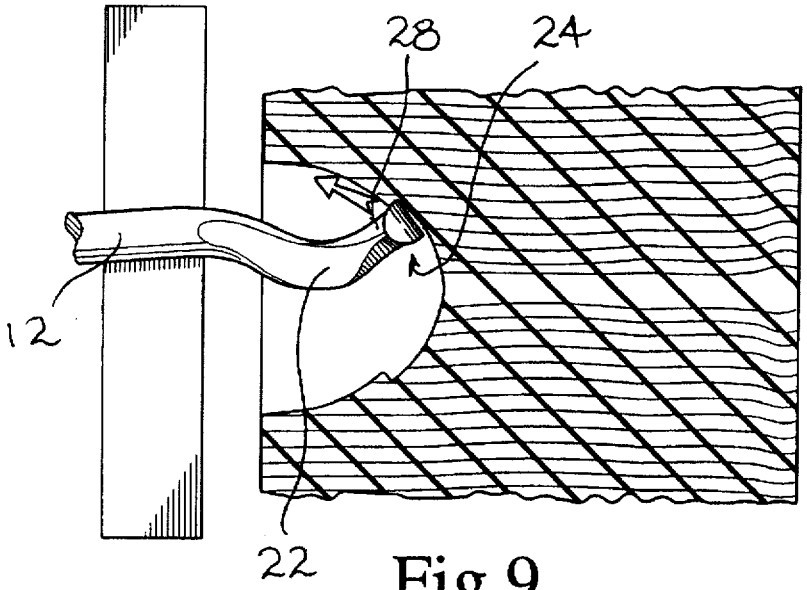
FIG. 9 is a partial cross-sectional view, similar to FIG. 7 illustrating a wood turning tool in accordance with the present invention.
Figure 10:
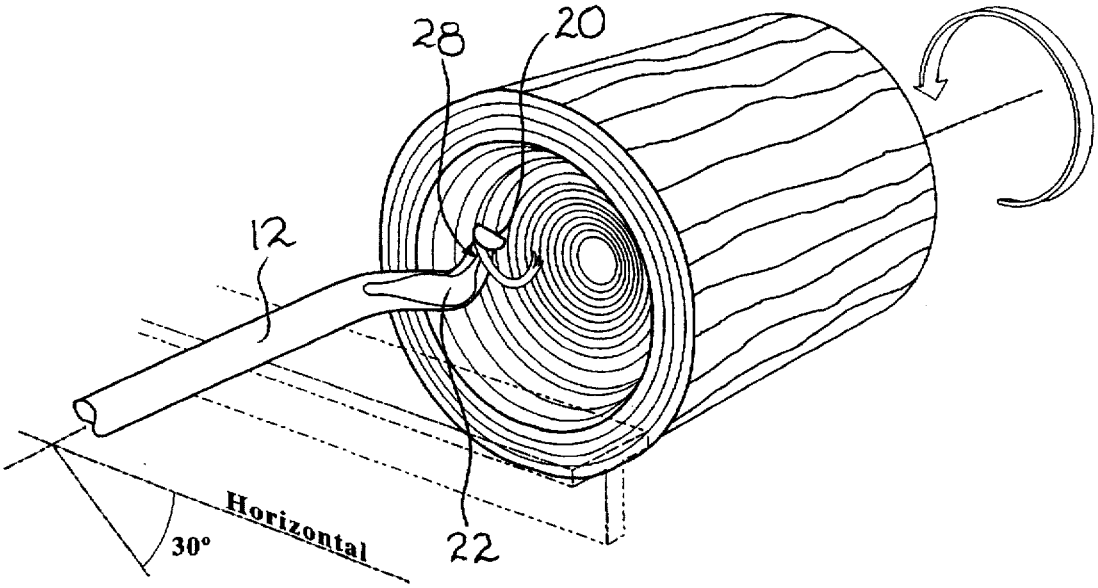
FIG. 10 is a perspective view illustrating use of the wood turning tool in accordance with the embodiment of FIG. 9.

Edge 26 is used in a pushing action as illustrated in FIGS. 7 and 8 to take into the wood in order to form a central recess which will be widened by a subsequent pulling action as illustrated in FIGS. 9 and 10 wherein cutting edge 28 is employed.

Figure 11:
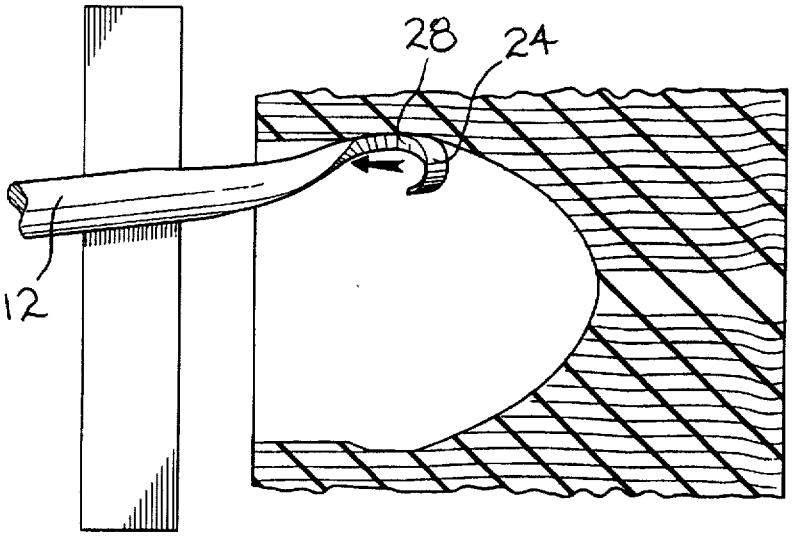
FIG. 11 is a partial cross-sectional view similar to FIG. 7, illustrating use of a wood turning tool in accordance with the present invention.
Figure 12:
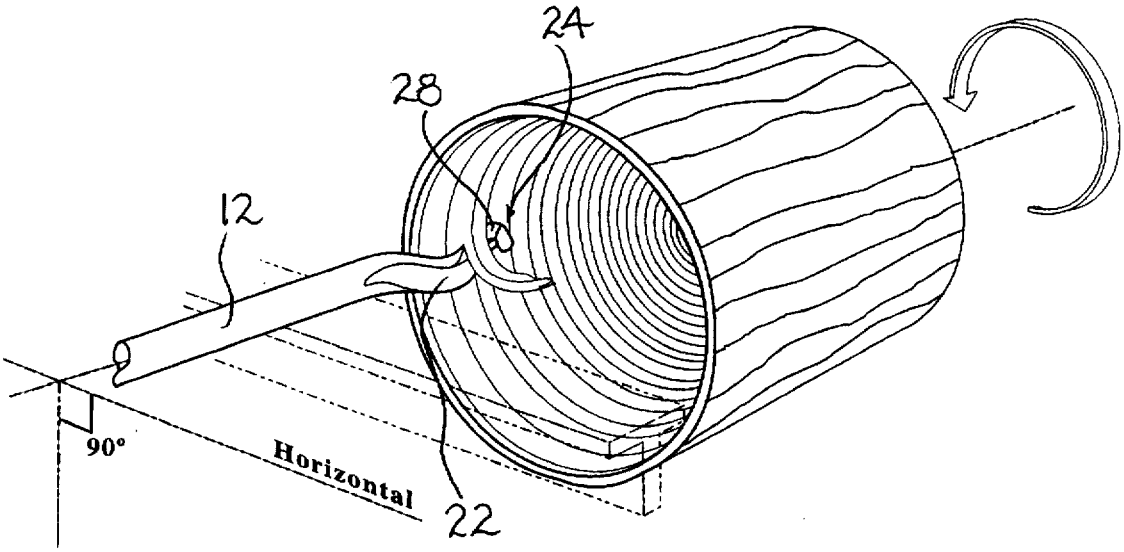
FIG. 12 is a perspective view, illustrating use of the wood turning tool in accordance with the embodiment of FIG. 11.

The cutting action is performed simultaneously with a rotation of the tool along its longitudinal axis as indicated in FIGS. 11 and 12.

Figure 13:
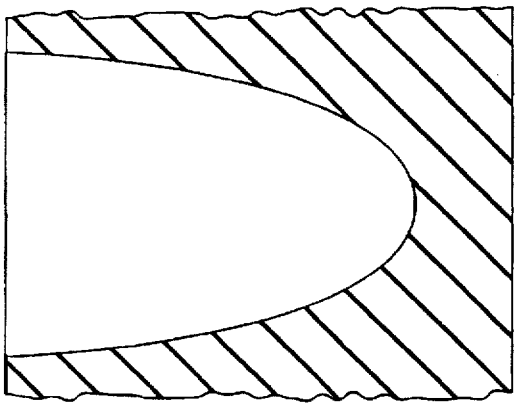
FIG. 13 is a cross sectional view of a carved article formed with the tool of the present invention.
Figure 15:
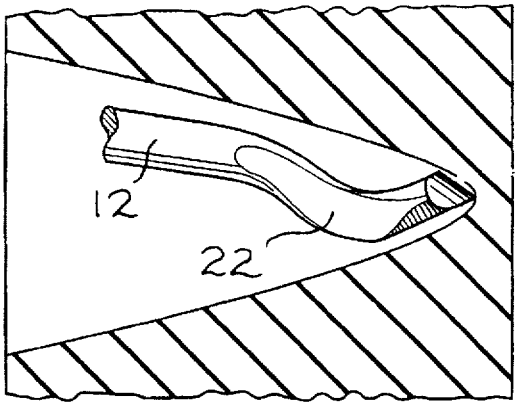
FIG. 15 is a partial cross sectional view illustrating use of the tool of FIG. 14.
Figure 17:
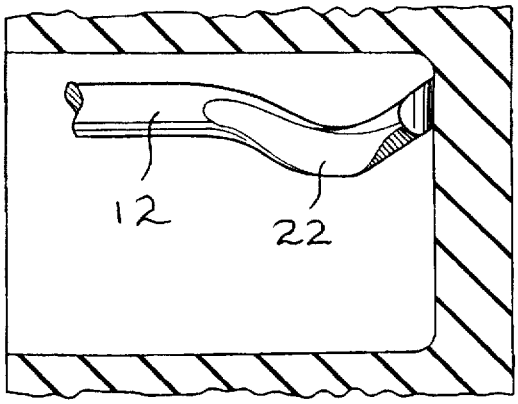
FIG. 17 is a partial cross sectional view illustrating use of the tool of FIG. 16.

As shown in FIGS. 13, 15 and 17, a variety of different shapes of recesses can be formed utilizing the tool of the present invention.

Figure 14:
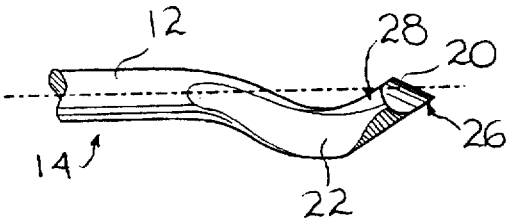
FIG. 14 is a side elevational view similar to FIG. 2 of a modified tool according to the present invention.
Figure 16:
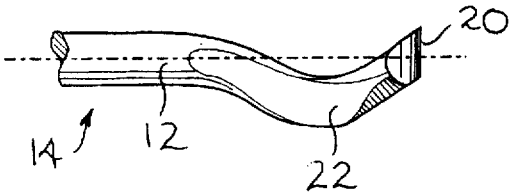
FIG. 16 is a side elevational view of a still further embodiment of the cutting head of a tool.

As previously mentioned, the bottom wall of the arcuate section may have its angle varied as shown in FIGS. 14 and 16 in order to give a desired configuration.

It will be understood that the above described embodiments are for purposes of illustration only and that changes and modifications may be made thereto without departing from the spirit and scope of the invention.

I claim:

1. A wood turning tool comprising a shank portion and a cutting head, said cutting head having, a first arcuate portion and a second arcuate portion, said shank portion having a longitudinal axis, said first arcuate section having a longitudinal axis which is arcuate and lies in a first plane which is angled with respect to a plane along said longitudinal axis of said shank portion, a second arcuate section merging with said first arcuate section, said second arcuate section having a longitudinal axis which is arcuate and which axis lies in a second plane which is angled with respect to said shank longitudinal axis plane and said first plane, said first and second arcuate segment having first and second cutting edges, said first and second cutting edges being on substantially opposed sides of said cutting tool.

2. The tool of claim 1 further including a handle member, said handle member being adapted to fit on said shank portion.

3. The tool of claim 1 further wherein said first and second cutting edges are located proximate a point where said second arcuate section merges with said first arcuate section.

4. The tool of claim 3 wherein said point where said first and second arcuate segment merge has a generally triangularly shaped cross sectional configuration comprising a base and a pair of inwardly tapering side walls, said cutting edges being defined by a piece edge and a side wall edge.

5. The tool of claim 4 wherein said tool is formed of a hardened steel.

6. A wood turning tool comprising a longitudinally extending member having a shank section, a first arcuate section, and a second arcuate section, said shank portion having a longitudinal axis, said first arcuate section having a longitudinal axis which has a concave configuration, said second arcuate segment merging with said first arcuate segment, said second arcuate segment having a longitudinal axis of a generally U-shaped configuration, said longitudinal axis of said second arcuate section being angled with respect to said longitudinal axis of said first arcuate section, and first and second cutting edges located proximate a point where said first and second arcuate sections merge.

* * * * *